US006817957B2

(12) United States Patent
Flaum et al.

(10) Patent No.: US 6,817,957 B2
(45) Date of Patent: Nov. 16, 2004

(54) METHOD AND APPARATUS FOR CUSTOM FITTING A HOCKEY STICK AND OTHER SPORTS EQUIPMENT

(75) Inventors: Richard V. Flaum, Birmingham, MI (US); Brian L. Klanow, Ortonville, MI (US)

(73) Assignee: Black Beauty Custom Sticks, LLC, Birmingham, MI (US)

( * ) Notice: Subject to any disclaimer, the term of this patent is extended or adjusted under 35 U.S.C. 154(b) by 0 days.

(21) Appl. No.: 10/819,843

(22) Filed: Apr. 7, 2004

(65) Prior Publication Data

US 2004/0192477 A1 Sep. 30, 2004

Related U.S. Application Data

(62) Division of application No. 10/309,839, filed on Dec. 4, 2002.

(51) Int. Cl.[7] ..... A63B 59/14
(52) U.S. Cl. ..... 473/563
(58) Field of Search ..... 473/560–563, 473/305–309, 313, 314

(56) References Cited

U.S. PATENT DOCUMENTS 1,697,846 A * 1/1929 Anderson ..... 473/246
3,102,736 A * 9/1963 Mueller et al. ..... 280/124.107
3,430,957 A * 3/1969 Andis ..... 473/248
4,736,951 A * 4/1988 Grant ..... 473/246
5,263,711 A * 11/1993 Addis et al. ..... 473/562
5,609,336 A * 3/1997 Tashjian ..... 473/560
5,816,961 A * 10/1998 Kraemer ..... 473/560
5,967,913 A * 10/1999 Sulenta ..... 473/560
6,068,563 A * 5/2000 Bengtsson ..... 473/562
6,361,451 B1 * 3/2002 Masters et al. ..... 473/318

* cited by examiner

*Primary Examiner*—Mark S. Graham
(74) *Attorney, Agent, or Firm*—Dobrusin & Thennisch PC

(57) ABSTRACT

The hockey stick and golf club of the present invention is generally formed of a shaft and a blade. The shaft has a grip at one end and a hosel at the opposite end. Similarly, the blade has a heel at one end and a toe at the opposite end. An incrementally locking indicia assembly rotatably attaches the heel end of the blade to the hosel of the shaft. The indicia assembly includes a scale for indicating the angle of the blade to the shaft. To adjust and customize this angle, the blade may be incrementally rotated up or down relevant to the shaft and locked into location for a trial skate by a hockey player or swing by a golfer. The lie angle of the blade may be adjusted after which is each trial skate to achieve maximum blade contact with a hockey puck or golf ball and increase shooting accuracy.

20 Claims, 5 Drawing Sheets

METHOD AND APPARATUS FOR CUSTOM FITTING A HOCKEY STICK AND OTHER SPORTS EQUIPMENT

RELATED CASES

The present application is a divisional of co-pending U.S. patent application Ser. No. 10/309,839, filed on Dec. 4, 2002, and is incorporated herein by reference.

TECHNICAL FIELD

The present invention relates to an adjustable lie hockey blade and a method for custom fitting a hockey blade to a hockey player. The present invention also provides a method and apparatus for custom fitting other sports to equipment such as a golf club to a golfer.

BACKGROUND OF THE INVENTION

Commercial hockey sticks generally have a fixed straight shaft and a blade having a fixed lie, loft and curvature. The maximum length of the shaft 15 and curvature of the blade is regulated by any number of individual hockey league governing bodies. Adjusting the hockey stick to fit the individual player is limited to cutting the length of the shaft to a more appropriate length. To adjust the loft and lie angle of the blade, the player is forced to purchase a different hockey stick or blade altogether.

To overcome this disadvantage, commercial hockey sticks may be purchased as a two-piece construction—a hockey blade with a hosel and a shaft separate from the blade and having an opening at one end for receiving the hosel of the blade. The blade hose) is provided with a heat-activated glue that is preferably heated by a hot air gun or a torch. Once the glue melts, the blade hosel is placed within the shaft opening. Upon the glue drying, the blade is permanently fixed to the shaft. To remove and replace the blade, the shaft and hosel area is reheated until the glue melts and the blade hosel may be slid from the shaft opening. Although this "quick change" blade replacement system saves the hockey player money, determining the proper lie of a hockey blade to a player is still a hit or miss proposition. There exists no method or apparatus for custom fitting a hockey blade for maximum blade contact with the ice and a hockey puck thereby increasing the accuracy of a hockey player's shot and greatly improving the player's puck handling ability.

There does exist, however, a multitude of devices and systems for custom fitting golf clubs to an individual golfer. Generally, these systems include devices that externally adapt to a prefabricated golf club to measure the existing lie and loft of the golf club head. Examples of such apparatuses are found at U.S. Pat. Nos. 4,858,332; 4,875,293; 5,105,550; 5,864,960; 5,884,409; 6,363,620; 6,430,829; 6,431,990; and 6,449,860.

Other devices for customizing the lie of the golf club head relative to the shaft are specifically directed to customizing a putter to an individual golfer. Examples of such apparatuses are found at U.S. Pat. Nos. 5,441,274 and 5,782,005.

Still other devices are available to adjust or modify the relationship of the golf club head to the shaft, however, these devices are independent of the golf club and involve an inordinate amount of measuring and bending to create the custom club desired. Examples of such apparatuses are found at U.S. Pat. Nos. 4,245,391; 4,245,392; 4,468,034; 4,549,357; 4,640,017; 4,788,774; 4,885,847; 5,105,550; 5,421,098; 5,864,960; 5,884,409; 5,974,645; 6,102,811; and 6,328,660.

SUMMARY OF THE INVENTION

The present invention provides a method and apparatus for custom fitting the lie of a hockey blade to a particular hockey player. The present invention may also be applied to customizing other sports related equipment, such as a golf club to a golfer.

The hockey stick of the present invention is generally formed of a shaft and a blade. In a preferred embodiment, the shaft is hollow throughout and supports a handle plug at one end and a blade at the opposite end. The shaft handle includes a grip at one end and the blade includes a hosel at the opposite end. Similarly, the blade has a heel at one end and a toe at the opposite end.

In a preferred embodiment, an incrementally locking indicia assembly rotatably attaches the heel end of the blade to the hosel of the shaft. The indicia assembly includes a scale for indicating the angle of the blade to the shaft. To adjust and customize this angle, the blade may be incrementally rotated up or down relevant to the shaft and locked into location for a trial skate by a hockey player. The lie angle of the blade may be adjusted after each trial skate to achieve maximum blade contact with the ice thereby increasing puck control and shooting of the individual player.

A second preferred embodiment of the present invention includes a quick-change blade assembly and shaft for receiving the removable and replaceable blade. In this embodiment, the blade assembly has a hosel extending from the heel end of the blade for fitting within a hollowed shaft. An incrementally locking indicia assembly is located between the hosel and the heel of the blade and includes a scale for indicating the angle of the blade to the shaft. To adjust and customize this angle, the blade may be incrementally rotated up or down relevant to the hosel and shaft and locked into location for a trial skate by a hockey player. The lie angle of the blade may be adjusted after each trial skate to achieve maximum blade contact with the ice thereby increasing puck control and shooting of the individual player.

In another preferred embodiment, the method for customizing the lie angle of a blade to a shaft is used to create a custom golf club for a golfer. In this embodiment and method, the shaft of the invention relates to a golf club shaft and the blade of the invention forms the club head of the golf club. The golf club head and shaft may form one unit in which the head is rotatable relative to the club head via an incrementally locking indicia assembly. Alternatively, the club head may be a quick-change head that is received within a hollowed shaft and rotates about the indicia assembly to adjust the lie angle for custom fitting a golf club.

These and other objects of the present invention will become apparent upon reading the following detailed description in combination with the accompanying drawings, which depict systems and components that can be used alone or in combination with each other in accordance with the present invention.

DESCRIPTION OF THE PREFERRED EMBODIMENT

Figure 1:
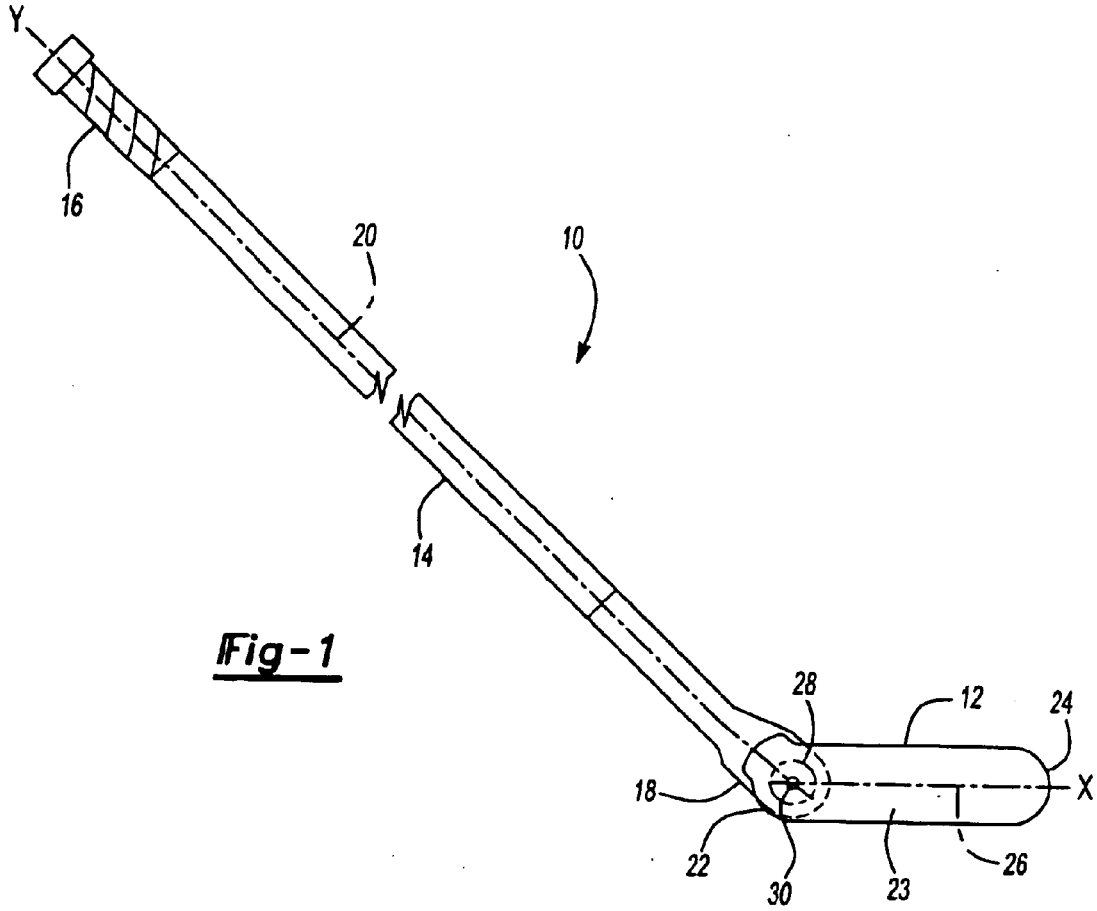
FIG. 1 illustrates a hockey stick of the present invention.
Figure 2:
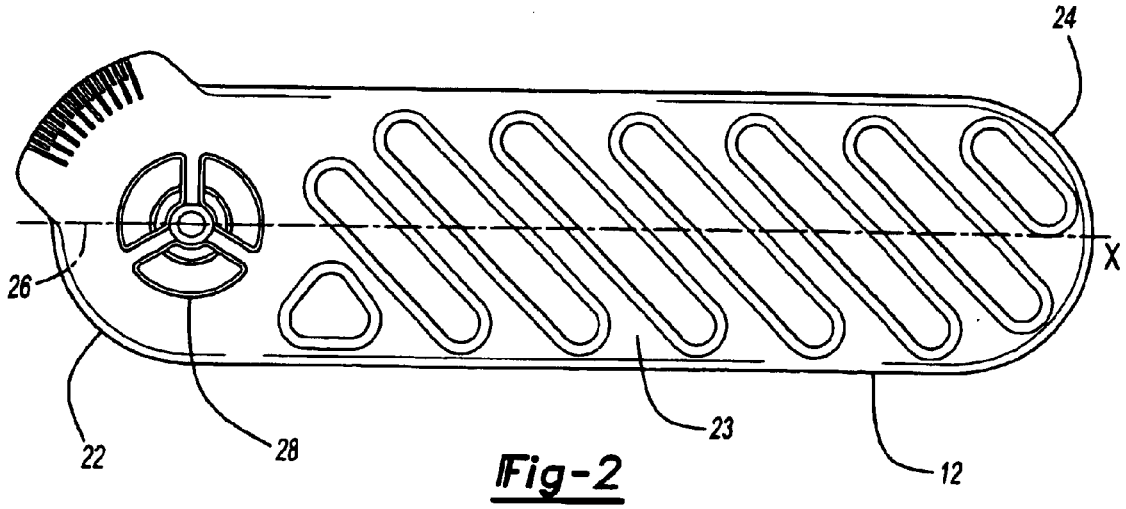
FIG. 2 is a side view illustrating a preferred embodiment of a hockey stick blade of the present invention.
Figure 3:
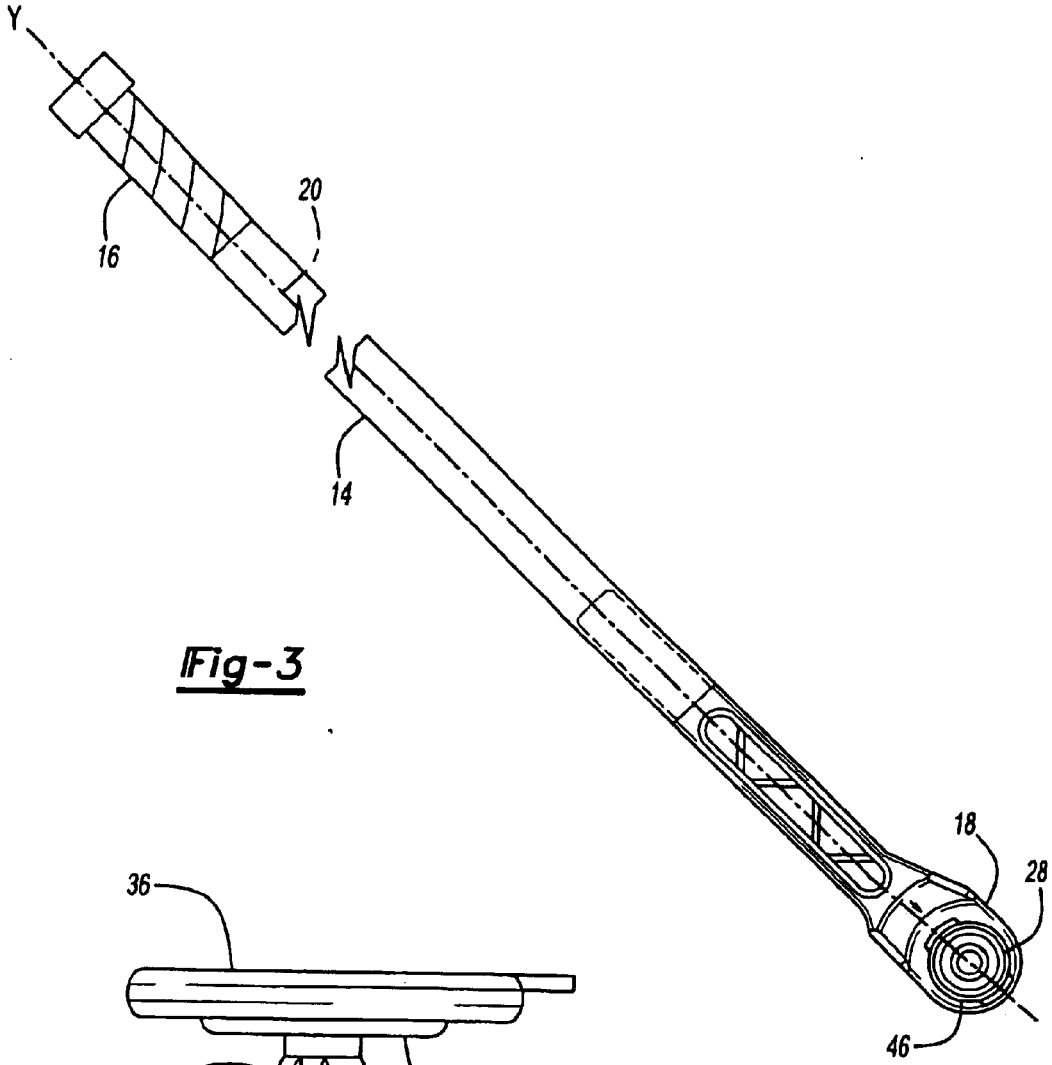
FIG. 3 is a side view illustrating a preferred embodiment of a hockey stick shaft of the present invention.
Figure 4A:
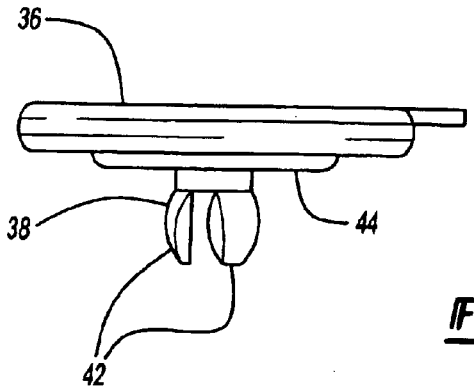
FIGS. 4A and 4B are a bottom view illustrating a preferred embodiment of an incrementally locking indicia assembly.
Figure 4B:
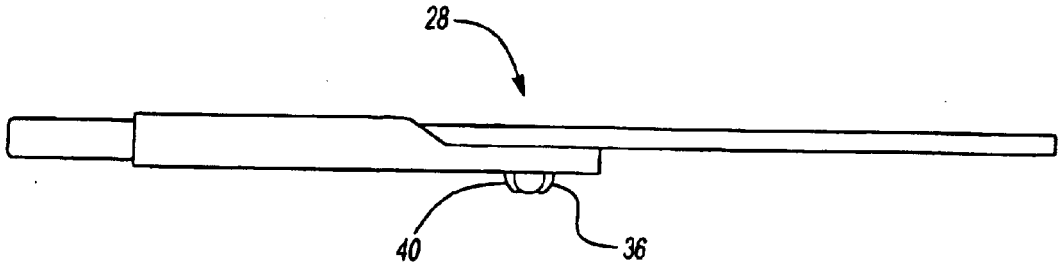
Figure 5:
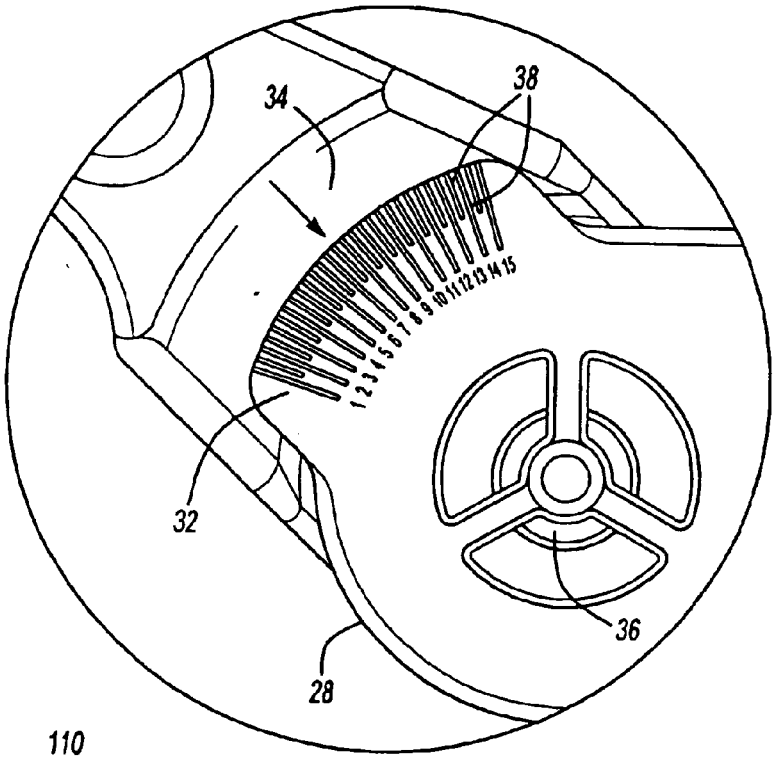
FIG. 5 is an enlarged view illustrating the incrementally locking indicia assembly of FIG. 4.

With reference to FIGS. 1–5, a hockey stick 10 of the present invention is there shown and includes a hockey blade 12 and a shaft 14. The shaft 14 (FIG. 2) has a grip 16 at one end and a hosel 18 opposite the grip 16 along the shaft 14. For purposes of describing the method for customizing the lie of a hockey stick 10, an imaginary Y-axis is shown extending along the centerline of the shaft 14.

The blade 12 (FIGS. 1 and 2) includes a heel 22 at one end and a toe 24 opposite the heel 22 and a blade face 23 forming the planar surface extending between them. For purposes of describing the method for customizing the lie of a hockey stick 10, an imaginary X-axis is shown extending along the centerline 26 of the blade 12.

As shown in FIGS. 1 and 3–5, an incrementally locking indicia assembly 28 rotatably attaches the heel end 22 of the blade 12 to the hosel end 18 of the shaft 14. The indicia assembly 28 forms an imaginary point of intersection 30 between the X and Y axes (FIG. 1.) The indicia assembly 28 includes a scale 32 and an indicator 34, such as the arrow shown in FIG. 5.

A clip 36 is preferably spring loaded and is embedded into the blade 12 at the heel 22 along the X-axis. The clip 36 includes a male locking mechanism 38 for engagement with a female seat 40. The male locking mechanism 38 preferably has opposing flexible arms 42 that are spaced apart from each other and able to deform upon forceful seating within the female seat 40. A protruding ridge 44 surrounds the male locking mechanism 38 and seats within a female guide 46 (FIG. 3) when the clip 36 is engaged. The clip 36 engages the shaft 14 at the hosel 18 along the Y-axis by pressure and clicks into place forming the imaginary point of intersection 30. The spring loaded clip 36 locks the blade 12 in an initial position to the hosel 14, allowing a hockey player to skate with the hockey stick 10 on the ice and shoot a puck without possible rotation of the blade 12 about the hosel 14. If the initial position is not the proper lie angle, the blade 12 may be rotated about the hosel 14 by simply placing pressure on the blade 12 to overcome the spring action of the clip 36. The female guide 46 directs the rotation of the male locking mechanism 38 and, thus, the blade 12.

The scale 32 of the indicia assembly 28 includes graduations 38 representing each degree of movement or rotation of the hockey blade 12 about the shaft 14. Therefore, movement of the X-axis 26 relative to the Y-axis 20 results in an angle measurable by the graduations 38 on the scale 32. This measurement provides an accurate reading of the preferred lie angle of the blade 12 to the shaft 14. In a preferred embodiment, each graduation 38 represents 2 degrees of movement of the blade 12 (X-axis 26) toward or away from the shaft 14 (Y-axis 20.) Other scales and degrees of graduation may be employed as a measuring tool where such indicia are for visually indicating the position of the blade face 23 to the hosel 18 when the toe 24 of the blade 12 is incrementally rotated about the hosel 18. A range of graduations between 1 and 15 is preferred and a range of graduations incremental to each degree is also envisioned, i.e. 1 degree. In a preferred embodiment, the numerical graduation of 5 represents a 45 degree angle between the hosel 18 and the shaft 14. Therefore, each change of lie angle represented by a graduation on the scale equals a 2 degree change, plus or minus, to the base angle of 45 degrees between the hosel and shaft. In a more preferred embodiment, each graduation on the scale represents a ½ increment of lie movement reflecting 1 degree of change, plus or minus, to the base lie angle of 45 degrees.

Figure 6:
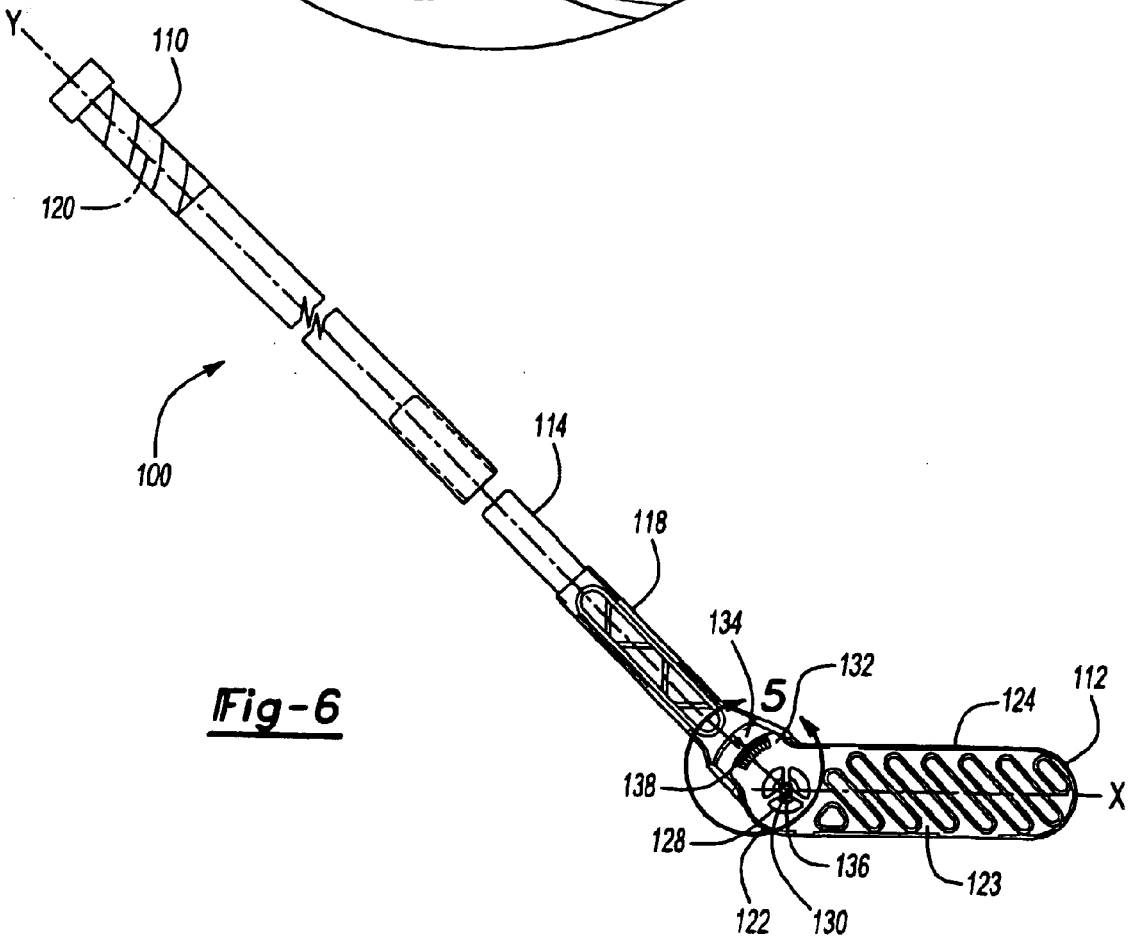
FIG. 6 is a side view illustrating a second preferred embodiment of the present invention.

With reference to FIG. 6, a second preferred embodiment of the present invention is there shown and illustrates a quick change blade replacement assembly 100 having a hosel 118 extending upward from the blade 112. The hose) 118 includes a shaft 114 that is seated within the hollowed end of a hockey stick (shown in phantom at 110, where the blade hosel is provided with a heat-activated glue that is generally heated by a hot air gun or a torch and once the glue melts, the blade hosel is placed with the shaft opening and seals upon cooling.) As set forth above, the hosel 118 includes an imaginary Y-axis shown extending along the centerline 120 of the hosel 118.

The blade 112 includes a heel 122 at one end and a toe 124 opposite the heel 122 and a blade face 123 forming the planar surface extending between them. For purposes of describing the method for customizing the lie of a quick change blade replacement assembly 100, an imaginary X-axis is shown extending along the centerline 126 of the blade 112.

The quick change blade replacement assembly 100 also includes an incrementally locking indicia assembly 128 that rotatably attaches the heel 122 of the blade 112 to the hosel 118. The indicia assembly 128 forms an imaginary point of intersection 130 between the X and Y axes. The indicia assembly 128 includes a scale 132 and an indicator 134, such as the arrow shown in FIG. 5.

A clip 136 is preferably spring loaded and is embedded into the blade 112 at the heel 122 along the X-axis. The clip 136 operates identically to the clip 36 above for visually indicating the position of the blade face 123 to the hosel 118 when the toe 124 of the blade 112 is incrementally rotated about the hosel 118. Therefore, the scale 132 of the indicia assembly 128 includes graduations 138 representing each degree of movement or rotation of the hockey blade 112 about the hosel 118. The movement of the X-axis 126 relative to the Y-axis 120 results in an angle measurable by the graduations 138 on the scale 132. This measurement provides an accurate reading of the preferred lie angle of the blade 112 to the hosel 118. In a preferred embodiment, each graduation 138 represents 2 degrees of movement of the blade 112 (X-axis 126) toward or away from the hosel 118 (Y-axis 120.) A range of graduations between 1 and 15 is preferred and a range of graduations incremental to each degree is also envisioned, i.e. 1 degree. In a preferred embodiment, the numerical graduation of 5 represents a 45 degree angle between the hosel 118 and the shaft 114. Therefore, each change of lie angle represented by a graduation on the scale equals a 2 degree change, plus or minus, to the base angle of 45 degrees between the hosel and shaft. In a more preferred embodiment, each graduation on the scale represents a ½ increment of lie movement reflecting 1 degree of change, plus or minus, to the base lie angle of 45 degrees.

Once the hockey stick of the present invention is formed as described above, the method for custom fitting the lie of a hockey blade to a particular hockey player is accomplished by setting the adjustable blade to an initial lie position and marking the lie angle on the indicia assembly. The hockey player then skates on the ice with the hockey stick and while controlling the puck, a stick specialist can observe and fit the player by adjusting the lie to the perfect angle for an individual player's needs. Once observed, the blade may be adjusted relative to the ice surface, the hosel or the shaft by rotating the blade up or down about the indicia assembly. Continuous readjustment may be necessary until maximum blade face contact with the ice and the bottom of the blade resulting in increased shooting and puck handling accuracy is achieved. When finally adjusted, the lie angle is measured via the indicia assembly and the hockey player is fitted with a hockey stick having a fixed blade with the customized lie angle.

Other modifications to the present invention include a blade, hosel and shaft formed of any one or combination of several types of materials such as aluminum, wood, a polymer, an alloyed steel such as tungsten, any carbon materials such as graphite or any other materials used in the industry that are capable of withstanding the repeated stress of a high speed shot or pass. The blade of may also be provided with a plurality of slots spaced along the blade face to aid in the manufacturing process and lessen manufacturing costs.

However, it is also envisioned that the present invention may be used successfully as a viable piece of equipment itself in compliance with NHL regulations. The incrementally locking assembly may be of any formation that provides for the visual indication of the angle between the blade and the hosel/shaft. Additionally, the locking assembly may be of any shape or form allowing for the rotation of the blade relative to the hosel/shaft.

Figure 7:
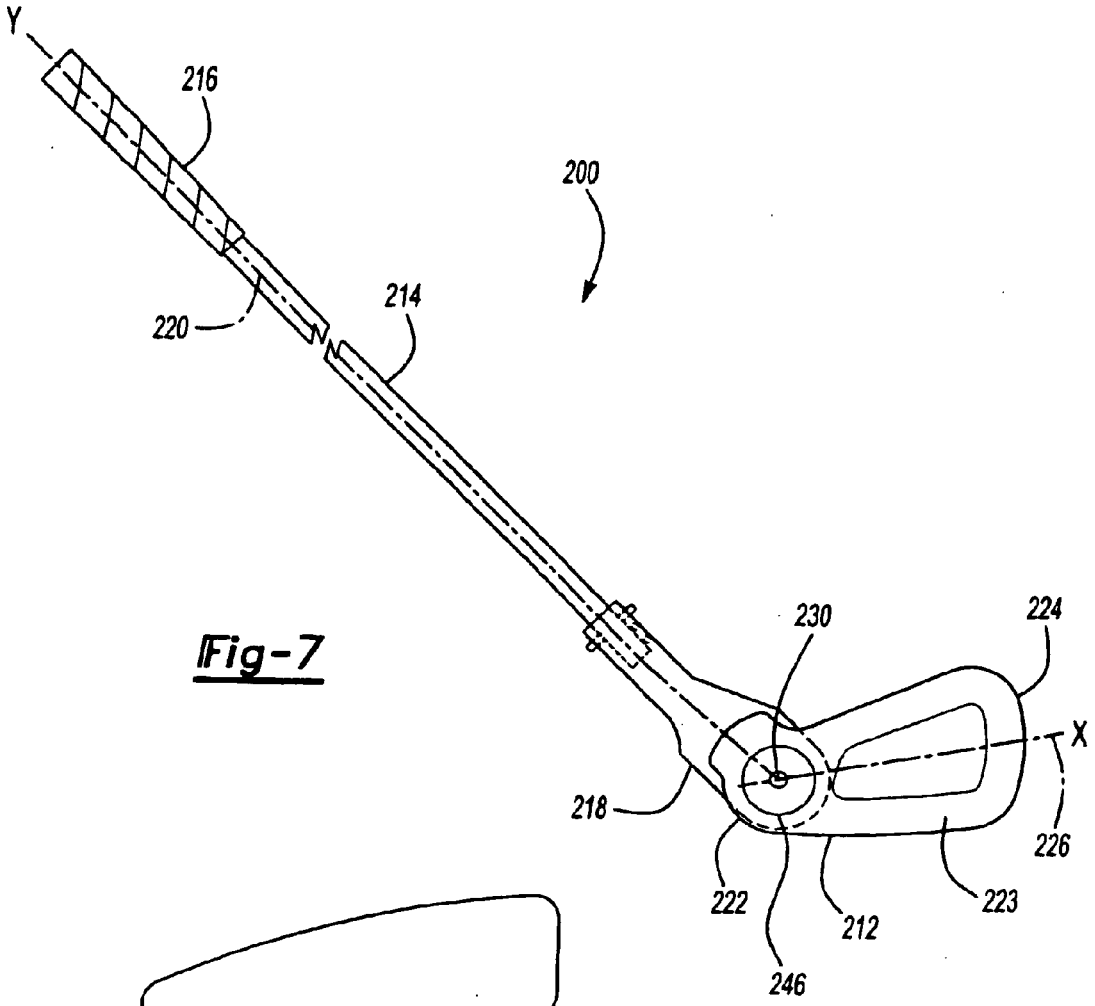
FIG. 7 is a side view illustrating a preferred embodiment of a golf club of the present invention.
Figure 8A:
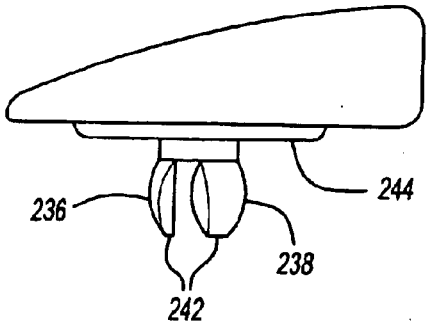
FIGS. 8A, 8B and 8C illustrate a preferred embodiment of an incrementally locking indicia assembly.
Figure 8B:
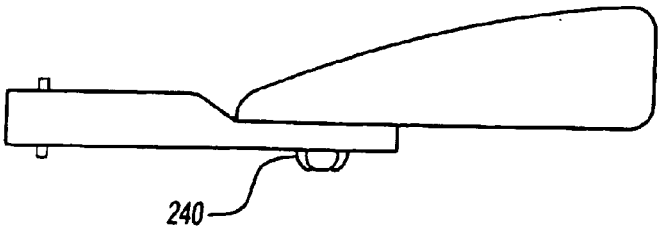
Figure 8C:
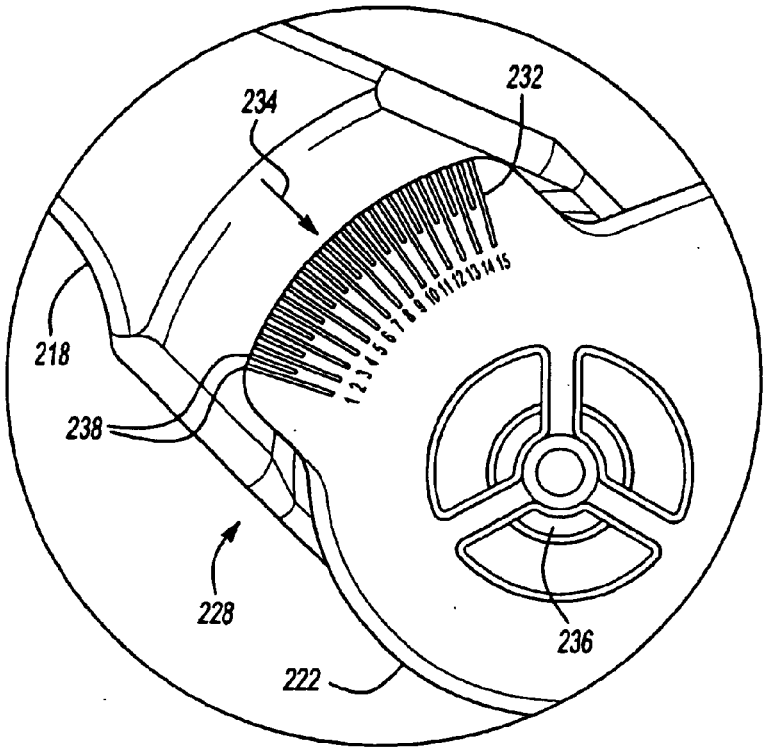
Figure 9:
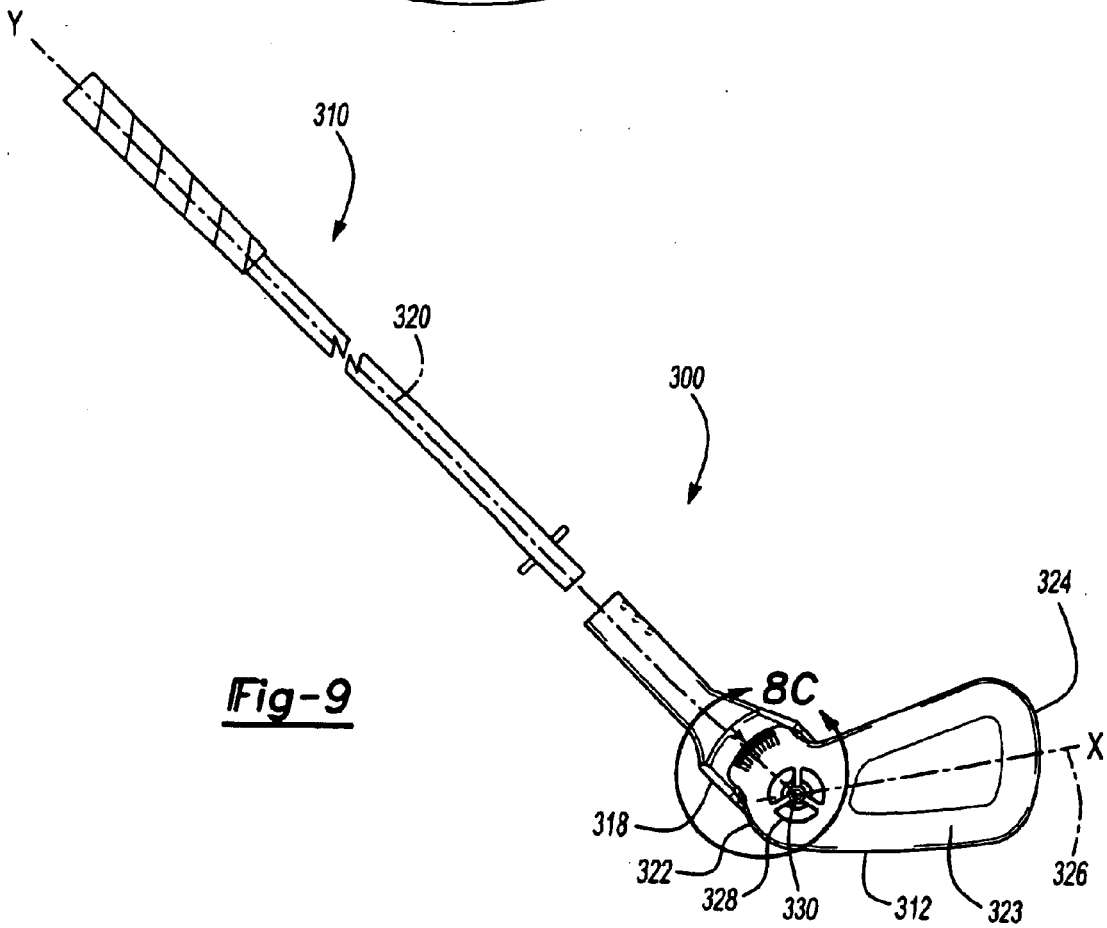
FIG. 9 is a side view illustrating a second preferred embodiment of a golf club of the present invention.

With reference to FIGS. 7–9, another preferred embodiment of the present invention is there shown for custom fitting a golf club 200. The golf club 200, like the hockey stick described above, includes a club head 212 and a shaft 214. The shaft 214 (FIG. 7) has a grip 216 at one end and a hosel 218 opposite the grip 216 along the shaft 214. For purposes of describing the method for customizing the lie of a golf club 200, an imaginary Y-axis is shown extending along the centerline 220 of the shaft 214.

The club head 212 includes a heel 222 at one end and a toe 224 opposite the heel 222 and a club head face 223 forming the planar surface extending between them. For purposes of describing the method for customizing the lie of a golf club 200, an imaginary X-axis is shown extending along the centerline 226 of the club head 212.

As shown in FIGS. 8A–C, an incrementally locking indicia assembly 228 rotatably attaches the heel end 222 of the club head 212 to the hosel end 218 of the shaft 214. The indicia assembly 228 forms an imaginary point of intersection 230 between the X and Y axes. The indicia assembly 228 includes a scale 232 and an indicator 234, such as the arrow shown in FIG. 5.

A clip 236 is preferably spring loaded and is embedded into the club head 212 at the heel 222 along the X-axis. The clip 236 includes a male locking mechanism 238 for engagement with a female seat 240. The male locking mechanism 238 preferably has opposing flexible arms 242 that are spaced apart from each other and able to deform upon forceful seating within the female seat 240. A protruding ridge 244 surrounds the male locking mechanism 238 and seats within a female guide 246 when the clip 236 is engaged. The clip 236 engages the shaft 214 at the hosel 218 along the Y-axis by pressure and clicks into place forming the imaginary point of intersection 230. The spring loaded clip 236 locks the club head 212 in an initial position to the hosel 214, allowing a golfer to swing the club at a practice range or on the golf course without possible rotation of the club head 212 about the hose) 214. If the initial position is not the proper lie angle, the club head 212 may be rotated about the hosel 214 by simply placing pressure on the club head 212 to overcome the spring action of the clip 236. The female guide 246 directs the rotation of the male locking mechanism 238 and, thus, the club head 212.

The scale 232 of the indicia assembly 228 includes graduations 238 representing each degree of movement or rotation of the club head 212 about the shaft 214. Therefore, movement of the X-axis 226 relative to the Y-axis 220 results in an angle measurable by the graduations 238 on the scale 232. This measurement provides an accurate reading of the preferred lie angle of the blade 212 to the shaft 214. In a preferred embodiment, each graduation 238 represents 2 degrees of movement of the club head 212 (X-axis 226) toward or away from the shaft 214 (Y-axis 220.) Other scales and degrees of graduation may be employed as a measuring tool where such indicia are for visually indicating the position of the clubface 223 to the hosel 218 when the toe 224 of the club head 212 is incrementally rotated about the hosel 218. A range of graduations between 1 degree and 15 is preferred and a range of graduations incremental to each degree is also envisioned, i.e. 1 degree.

With reference to FIG. 9, a second preferred embodiment of the golf club of the present invention is there shown and illustrates a quick change club head replacement assembly 300 having a hosel 318 extending upward from the club head 312. The hosel 318 includes a shaft 314 that is seated within the hollowed end of a golf club shaft (shown in phantom at 310, where the club head hosel is provided with a set of spring loaded arms able to retract into the hose) when the hose) is slid into the shaft. The arms then release into the matching openings provided along the perimeter of the shaft, locking the club head to the shaft. Other mechanisms for providing a quick change replacement assembly are envisioned such as a threaded end on the club head for screwing into the shaft.) As set forth above, the hosel 318 includes an imaginary Y-axis shown extending along the centerline 320 of the hosel 318.

The club head 312 includes a heel 322 at one end and a toe 324 opposite the heel 322 and a blade face 323 forming the planar surface extending between them. For purposes of describing the method for customizing the lie of a quick change club head replacement assembly 300, an imaginary X-axis is shown extending along the centerline 326 of the club head 312.

The quick change club head replacement assembly 300 also includes an incrementally locking indicia assembly 328 that rotatably attaches the heel 322 of the club head 312 to the hosel 318. The indicia assembly 328 forms an imaginary point of intersection 330 between the X and Y axes (FIGS. 8A–C.) The indicia assembly 328 includes a scale 332 and an indicator 334, such as the arrow shown in FIG. 5. A clip 336 is preferably spring loaded and is embedded into the blade 312 at the heel 322 along the X-axis. The clip 336 operates identically to the clip 36 above for visually indicating the position of the club head face 323 to the hosel 318 when the toe 324 of the blade 312 is incrementally rotated about the hosel 318. Therefore, the scale 332 of the indicia assembly 328 includes graduations 338 representing each degree of movement or rotation of the club head 312 about the hosel 318. The movement of the X-axis 326 relative to the Y-axis 320 results in an angle measurable by the graduations 338 on the scale 332. This measurement provides an accurate reading of the preferred lie angle of the club head 312 to the hosel 318. In a preferred embodiment, each graduation 338 represents 2 degrees of movement of the club head 312 (X-axis 326) toward or away from the hosel 318 (Y-axis 320.) A range of graduations between 1 degree and 15 is preferred and a range of graduations incremental to each degree is also envisioned, i.e. 1 degree.

Once the golf club of the present invention is formed as described above, the method for custom fitting the lie of a club head to a particular golfer is accomplished by setting the adjustable club head to an initial lie position and marking the lie angle on the indicia assembly. The golfer then hits several golf balls at a golf range to observe the flight and accuracy of the golf ball off the club head face. Once observed, the club head may be adjusted relative to the range surface (grass or mat,) the hosel or the shaft by rotating the club head up or down about the indicia assembly. Continuous readjustment may be necessary until maximum clubface contact with a golf ball and increased is distance and ball flight accuracy is achieved. When finally adjusted, the lie angle is measured via the indicia assembly and the golfer is fitted with a golf club having a fixed blade with the customized lie angle.

Other modifications to the present invention include a club head, hosel and shaft formed of any one or combination of several types of materials such as wood, a polymer, an alloyed steel such as tungsten, any carbon materials such as graphite or any other materials used in the industry that are capable of withstanding the repeated stress of a golf ball contacting the club head at any speed. The club head of may also be provided with a plurality of slots spaced along the club head face to aid in the manufacturing process and lessen manufacturing costs. However, it is also envisioned that the present invention may be used successfully as a viable piece of equipment itself in compliance with the Professional Golf Association (PGA.) The incrementally locking assembly may be of any formation that provides for the visual indication of the angle between the club head and the hosel/shaft.

Additionally, the locking assembly may be of any shape or form allowing for the rotation of the club head relative to the hosel/shaft.

Although the invention has been described with particular reference to certain preferred embodiments thereof, variations and modifications can be effected within the spirit and scope of the following claims.

What is claimed is:

1. A hockey stick comprising:

a shaft comprising a grip at a first end and a hosel at a second end opposite said first end, said shaft having an imaginary Y-axis extending along the centerline of the handle lengthwise between said first and second ends; and a blade comprising a heel at a first end and a toe at a second end opposite said first end, said blade having an imaginary X-axis extending along the centerline of said blade lengthwise between said first and second ends;

said first end of said blade rotatably attached to said second end of said shaft at an imaginary point of intersection between said X and Y axes and including an indicia assembly;

said indicia assembly comprising an incrementally locking assembly and a scale for visually indicating the angle between the X and Y axes when said toe of said blade is incrementally rotated about said hosel of said shaft.

2. The hockey stick of claim 1, wherein said scale of said indicia assembly further comprises graduations representing each degree of movement or rotation of said hockey blade about said shaft.

3. The hockey stick of claim 2, wherein said each of said graduations represents 2 degrees of movement of said blade toward or away from said shaft.

4. The hockey stick of claim 2, wherein said each of said graduations represents 1 degree of movement of said blade toward or away from said shaft.

5. The hockey stick of claim 2, wherein said graduations measure the movement of said X-axis relative to said Y-axis and provide an accurate reading of the preferred lie angle of said blade to said shaft.

6. A hockey stick comprising:

a shaft comprising a grip at a first end and a hosel at a second end opposite said first end; and a blade comprising a heel at a first end and a toe at a second end opposite said first end;

said first end of said blade rotatably attached to said second end of said shaft and including an indicia assembly;

said indicia assembly comprising an incrementally locking assembly and a scale for visually indicating the position of said blade to said shaft when said toe of said blade is incrementally rotated about said hosel of said shaft.

7. The hockey stick of claim 6, wherein said scale of said indicia assembly further comprises graduations representing each degree of movement or rotation of said hockey blade about said shaft.

8. The hockey stick of claim 7, wherein said each of said graduations represents 5 degrees of movement of said blade toward or away from said shaft.

9. The hockey stick of claim 7, wherein said each of said graduations represents 1 degree of movement of said blade toward or away from said shaft.

10. A hockey blade assembly comprising:

a hosel having a first end and a second end opposite said first end and having an imaginary Y-axis extending along the centerline of said hosel lengthwise between said first and second ends;

a blade including a planar surface forming the blade face extending from said second end of said hosel; and an indicia assembly rotatably attaching said blade to said hosel;

said indicia assembly comprising an incrementally locking assembly and a scale located on said blade face for visually indicating the position of said blade face to said hosel when said toe of said blade is incrementally rotated about said hosel.

11. The hockey blade assembly of claim 10, said blade face further comprising a heel extending from said second end of said hosel and a toe opposite said heel said blade having an imaginary X-axis extending along the centerline of said blade face lengthwise between said heel and said toe.

12. The hockey blade assembly of claim 10, wherein said scale of said indicia assembly further comprises graduations representing each degree of movement or rotation of said hockey blade about said hosel.

13. The hockey blade assembly of claim 10, wherein said each of said graduations represents 2 degrees of movement of said blade toward or away from said hosel.

14. The hockey blade assembly of claim 10, wherein said each of said graduations represents 1 degree of movement of said blade toward or away from said shaft.

15. The hockey blade assembly of claim 11, wherein said graduations measure the movement of said X-axis relative to said Y-axis and provide an accurate reading of the preferred lie angle of said blade to said hosel.

16. The hockey blade assembly of claim 11, wherein said scale of said indicia assembly further comprises graduations representing each degree of movement or rotation of said hockey blade about said hosel.

17. The hockey blade assembly of claim 15, wherein said each of said graduations represents 2 degrees of movement of said blade toward or away from said hosel.

18. The hockey blade assembly of claim 15, wherein said each of said graduations represents 1 degree of movement of said blade toward or away from said shaft.

19. The hockey blade assembly of claim 16, wherein said each of said graduations represents 2 degrees of movement of said blade toward or away from said hosel.

20. The hockey blade assembly of claim 16, wherein said each of said graduations represents 1 degree of said blade toward or away from said shaft.

* * * * *